US009688504B2

(12) United States Patent
Shirley, IV

(10) Patent No.: US 9,688,504 B2
(45) Date of Patent: Jun. 27, 2017

(54) YARN FEED ASSEMBLY TO RELIEVE YARN HANG UPS HAVING A VARIABLE YARN PULL-OFF ANGLE AND METHOD OF USING SAME

(71) Applicant: COLUMBIA INSURANCE COMPANY, Omaha, NE (US)

(72) Inventor: Lewis Albert Shirley, IV, White, GA (US)

(73) Assignee: COLUMBIA INSURANCE COMPANY, Omaha, NE (US)

( * ) Notice: Subject to any disclaimer, the term of this patent is extended or adjusted under 35 U.S.C. 154(b) by 232 days.

(21) Appl. No.: 14/710,099

(22) Filed: May 12, 2015

(65) Prior Publication Data

US 2015/0321875 A1 Nov. 12, 2015

Related U.S. Application Data

(60) Provisional application No. 61/992,080, filed on May 12, 2014.

(51) Int. Cl.
*B65H 49/16* (2006.01)
*B65H 57/00* (2006.01)
(Continued)

(52) U.S. Cl.
CPC ..... *B65H 49/16* (2013.01); *B65H 49/32* (2013.01); *B65H 57/00* (2013.01); *B65H 57/06* (2013.01);
(Continued)

(58) Field of Classification Search
CPC ..... B65H 49/16; B65H 57/06; B65H 57/12; B65H 57/18; B65H 59/36; D02H 1/00
See application file for complete search history.

(56) References Cited

U.S. PATENT DOCUMENTS 2,214,156 A 9/1940 Andrews
4,165,056 A 8/1979 Singer
(Continued)

FOREIGN PATENT DOCUMENTS

CN 203346563 U 12/2013
FR 2536376 A1 * 5/1984 ..... B65H 59/36
GB 2139251 A 11/1984

OTHER PUBLICATIONS

International Search Report and Written Opinion of the International Searching Authority for application PCT/US2015/030350, filed on May 12, 2015 (Applicant—Shaw Industries Group, Inc. // Inventor—Shirley) (14 pages).

*Primary Examiner* — William E Dondero
(74) *Attorney, Agent, or Firm* — Ballard Spahr LLP

(57) ABSTRACT

A yarn feed assembly for directing yarn from a wound yarn source to a yarn feed tube having a frame member positioned adjacent to the wound yarn source and defining at least one elongate interior chamber. The yarn feed assembly has a weighted member slideably received in the elongate interior chamber such that, upon pulling one yarn off of the wound yarn source, through a bore of the weighted member and into the yarn feed tube, the weighted member is axially movable along a longitudinal axis of the frame member such that the bore of the weighted member is axially movable about and between a bottom end and a top end of the elongate slot in response to tension applied to the yarn as a result of yarn hang ups on the wound yarn source.

39 Claims, 9 Drawing Sheets

(51) Int. Cl.

| | |
|---|---|
| ***B65H 49/32*** | (2006.01) |
| ***B65H 59/36*** | (2006.01) |
| ***D02H 1/00*** | (2006.01) |
| ***B65H 57/16*** | (2006.01) |
| ***B65H 57/12*** | (2006.01) |
| ***B65H 57/06*** | (2006.01) |
| ***B65H 59/24*** | (2006.01) |
| ***B65H 63/04*** | (2006.01) |

(52) U.S. Cl.
CPC ..... *B65H 57/12* (2013.01); *B65H 57/16* (2013.01); *B65H 59/24* (2013.01); *B65H 59/36* (2013.01); *B65H 63/04* (2013.01); *D02H 1/00* (2013.01); *B65H 2701/31* (2013.01)

(56) References Cited

U.S. PATENT DOCUMENTS

| | | | | |
|---|---|---|---|---|
| 6,634,585 | B1 * | 10/2003 | Ingram, III | B65H 49/16 242/131.1 |
| 6,945,490 | B1 * | 9/2005 | Zollinger | B65H 59/22 242/152.1 |
| 8,869,720 | B2 * | 10/2014 | Ingram, III | B65H 49/16 112/80.01 |
| 2004/0050995 | A1 * | 3/2004 | Ingram, III | B65H 49/16 242/594.6 |
| 2010/0090050 | A1 * | 4/2010 | Vaughan | B65H 49/16 242/131 |

* cited by examiner

YARN FEED ASSEMBLY TO RELIEVE YARN HANG UPS HAVING A VARIABLE YARN PULL-OFF ANGLE AND METHOD OF USING SAME

CROSS REFERENCE TO RELATED PATENT APPLICATION

This application claims priority to U.S. Provisional Application No. 61/992,080 filed May 12, 2014, which is herein incorporated by reference in its entirety.

FIELD OF THE INVENTION

This invention relates to a yarn feed assembly for directing yarn from a wound yarn source to a yarn feed tube. More specifically, this invention relates to a yarn feed assembly configured for to reduce or eliminate yarn hang ups coming off of the bobbin or wound yarn source in a carpet manufacturing process.

BACKGROUND OF THE INVENTION

A standard creel has a frame provided with a plurality of vertical rows of holders each adapted to hold a respective bobbin comprised of a tubular core and a mass of filament—yarn or thread—wound on the core. A filament is pulled from each bobbin and guided through a respective eye, whence it passes to a warp or weft system of a loom or the like. A standard creel can hold hundreds and even thousands of bobbins, thus space requirement is a problem. Additionally, conventional creel design requires that the tufting machine be placed out of operation during the times an operator is required to change the bobbins on the creel in order to change yarns.

Unfortunately, it is common for yarn to hang up as it is pulled off of the bobbin, which requires the operation to be shut down until the hang up is cleared. It is not uncommon to have inefficiencies because of such hang ups and shutdowns that can undesirably exceed 50%.

SUMMARY

The invention relates to a yarn feed assembly for directing yarn from a wound yarn source to a yarn feed tube that is configured to automatically dear yarn hang ups. In one aspect, the yarn heed assembly comprises a frame member positioned adjacent to the wound yarn source. In one aspect, the frame member defines at least one elongate interior chamber and a parallel elongate slot that has a bottom end and an opposed top end and is in communication with at least a portion of the elongate interior chamber.

In another aspect, the yarn feed assembly can also have a weighted member that is configured to be slideably received in the elongate interior chamber. In one aspect, a bore is defined in the weighted member that is sized and shaped to operatively received yarn therethrough. In operation, and upon pulling one yarn off of the wound yarn source, through the bore of the weighted member and into the yarn feed tube, the weighted member is configured to be axially movable along a longitudinal axis of the frame member such that, in response to tension applied to the yarn as a result of yarn hang ups on the wound yarn source, the bore of the weighted member can be axially movable about and between a bottom end and a top end of the elongate slot.

In a further aspect, under tension, the yarn extending from the wound yarn source to the bore of the weighted member is at a variable yarn pull-off angle that is minimized when the weighted member is at the bottom end of the elongate slot of the frame member and is maximized when the weighted member is at the top end of the elongate slot of the frame member. In operation, the variable yarn pull-off angle will increase to the angle that allows the yarn hang up to automatically clear. Upon clearing of the hang up, which results from the increased variable yarn pull-off angle, and the subsequent decrease in tension applied to the yarn, the weighted member will drop to the bottom end of the elongate slot and the variable yarn pull-off angle will be minimized.

In one aspect, the yarn feed assembly can be coupled to a creel for organizing wound yarn sources and directing yarn to a tufting machine. In one aspect, the creel can have an outer frame and an inner frame, which can be selectively movable relative to the outer frame. The inner frame is configured to hold a plurality of wound yarn sources and the outer frame comprises a plurality of yarn feed tubes configured to direct the yarn from the plurality of wound yarn sources to a header that, in turn, directs the yarn from the creel to specific portions of a tufting machine.

In one aspect, the outer frame of the creel can comprise a plurality of substantially upright support members and define an enclosure. In another aspect, the enclosure can be open at one end and define an interior volume. The creel may also have a header mountable thereon a portion of the outer frame. In one aspect, the header can define a plurality of openings configured to direct yarn to a predetermined position on the tufting machine.

In a further aspect, the creel further comprises a plurality of yarn feed tubes, each having a distal end portion that is mounted thereon at least a portion of at least some of the substantially upright support members of the outer frame. In this aspect, each of the yarn feed tubes extends to and is in communication with a respective opening on the header.

In another aspect, the creel also comprises an inner frame that is configured to be matingly positionable within the interior volume of the enclosure. The inner frame may have a plurality of upright elements and a plurality of yarn holders extending therefrom each upright element. The yarn holders are configured to hold a wound yarn source or bobbin. In a further aspect, each of the yarn holders is spaced from the elongate slot of a frame member and the respective bore of the weighted member that is operative received therein the frame member of the yarn feed assembly when the inner frame is operably positioned within the interior volume of the enclosure.

In one aspect, a portion of each of the yarns that had previously been fed through the tubes and connected through the header to the tufting machine remains exterior to the proximal end of each of the tubes. In this manner, an inner frame may be released from the interior volume and replaced with another inner frame. At this point, and in operation, each of the yarn packages may be connected to the respective yarn end that extends therefrom the respective rube and tied off.

DETAILED DESCRIPTION OF THE FIGURES

These and other features of the preferred embodiments of the invention will become more apparent in the detailed description in which reference is made to the appended drawings wherein:

FIG. 1 is a partial cross-section end elevational of a yarn feed assembly for directing yarn from a wound yarn source to a yarn feed tube that is configured to automatically dear yarn hang ups according to one aspect of the present invention, illustrating a frame member positioned adjacent to the wound yarn source that defines at least one elongate interior chamber and a parallel elongate slot that has a bottom end and an opposed top end and is in communication with at least a portion of the elongate interior chamber; and a weighted member that is configured to be slideably received in the elongate interior chamber and defines a bore that is sized and shaped to operatively received yarn therethrough. This illustration shows the relationship between the wound yarn source, the yarn feed assembly, and the yarn feed tube whereby, in operation, upon pulling one yarn off of the wound yarn source, through the bore of the weighted member and into the yarn feed tube, the weighted member is configured to be axially movable along a longitudinal axis of the frame member such that, in response to tension applied to the yarn as a result of yarn hang ups on the wound yarn source, the bore of the weighted member can be axially movable about and between a bottom end and a top end of the elongate slot.

FIG. 2 is a partial enlarged end elevation view of the yarn feed assembly of FIG. 1, illustrating the weighted member that is sized and shaped for complementary slideably receipt therein the shaped interior chamber of the frame member, one weighted member is shown positioned at the bottom end of the elongate slot of the frame member as a result of the tension in the yarn being at a nominally operative level because of no hang ups on the wound yarn source (i.e., no hangups on the wound yarn source, thus there is an insufficient increase in tension applied to the yarn to move the weighted member from the bottom end of the slot of the slot of the frame member and the variable pull off angle a is minimized) and one weighted member is shown being urged to toward the top end of the elongate slot of the frame member as a result of increased tension in the yarn because of a hang up on the wound yarn source.

Figure 1:
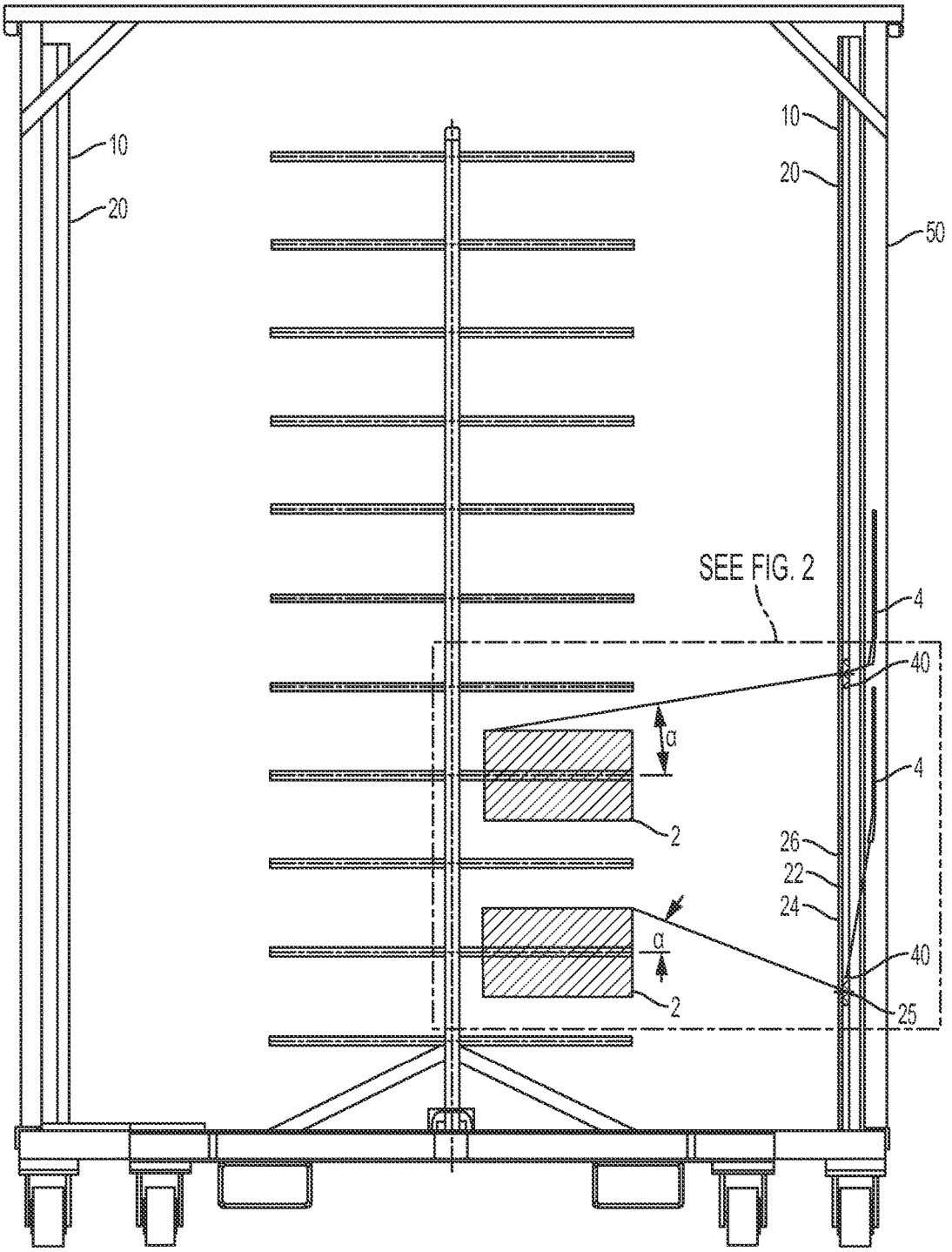
Figure 2:
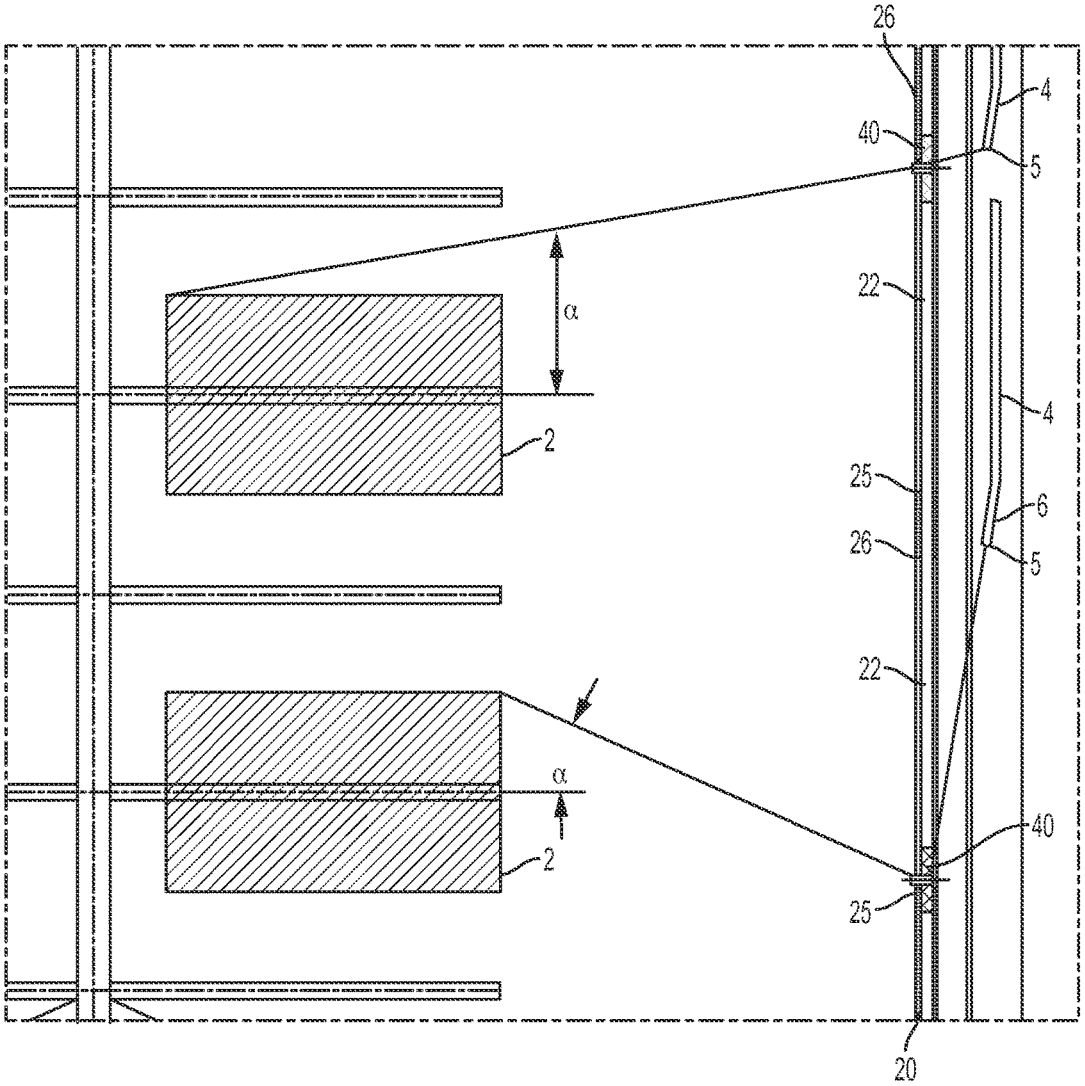
Figure 3:
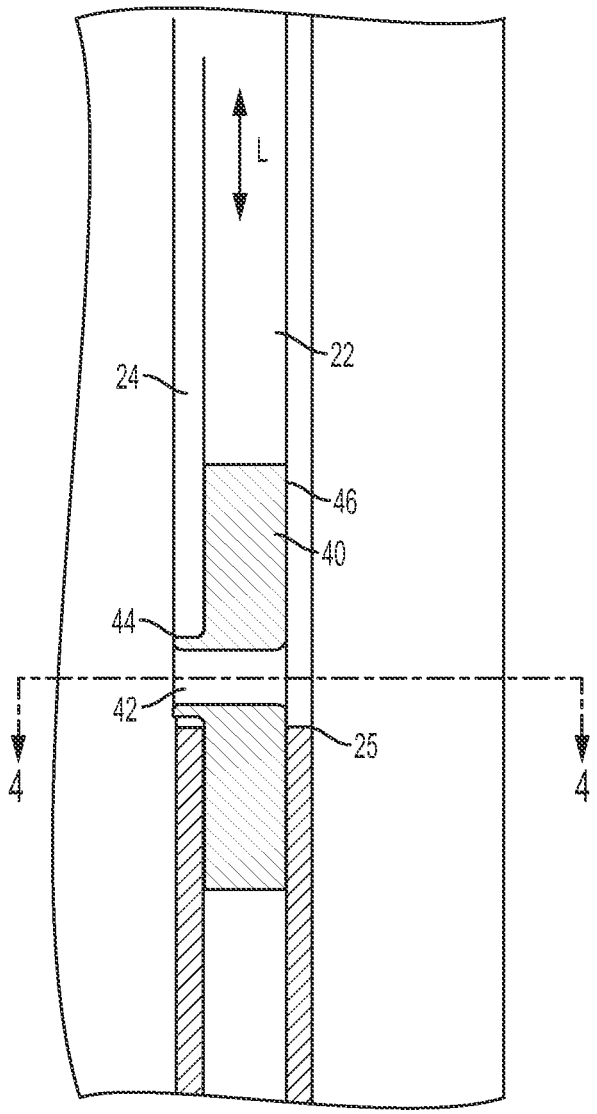
FIG. 3 is a partial enlarged cross-section view of the yarn feed assembly of FIG. 2, illustrating the weighted member positioned at the bottom end of the elongate slot of the frame member.
Figure 4:
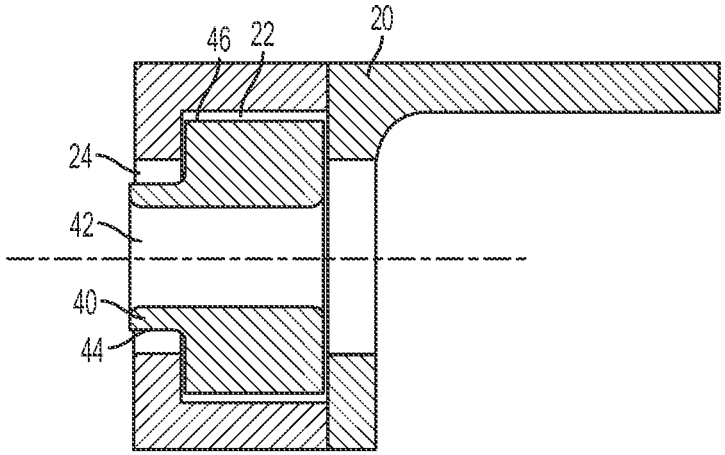
FIG. 4 is a cross-sectional view of the yarn feed assembly of FIG. 3 taken along Line 4-4 of FIG. 3, illustrating that the weighted member is sized and shaped for complementary slideably receipt therein the shaped interior chamber and that the bore extends through the male tube projection of the weighted member. Also illustrated is the chamfered edges of the respective ends of the defined bore.
Figure 5A:
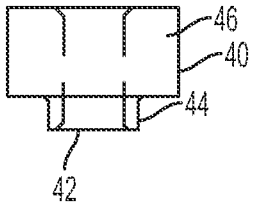
Figure 5B:
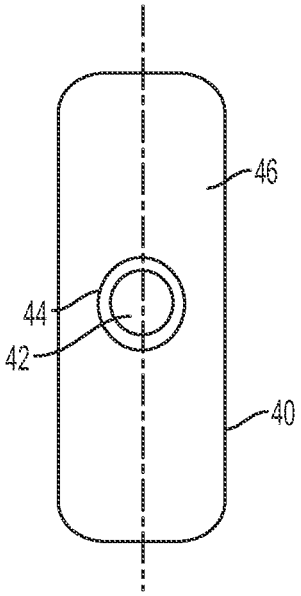
Figure 5C:
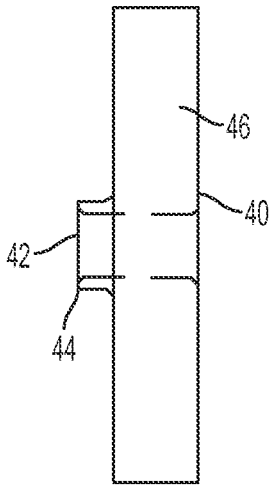

FIGS. 5A, 5B, and 5C shows top, end and side elevation views of a weighted member of the yarn feed assembly of FIG. 1.

Figure 6:
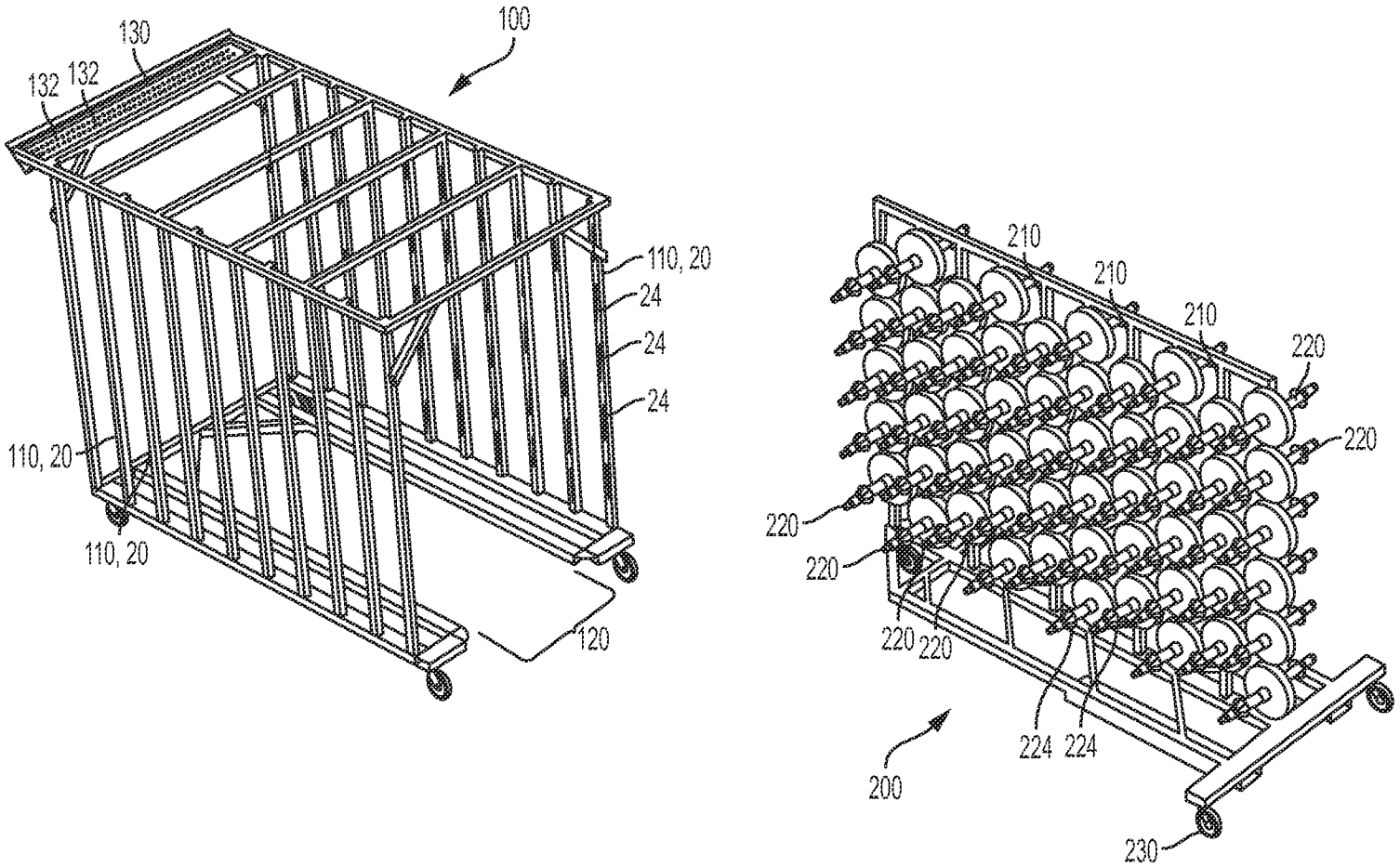

FIG. 6 is a perspective view of the yarn feed assembly of FIG. 1 mounted thereon a creel and illustrating the inner frame outside of the enclosure defined by the outer frame according to one aspect of the present invention.

Figure 7:
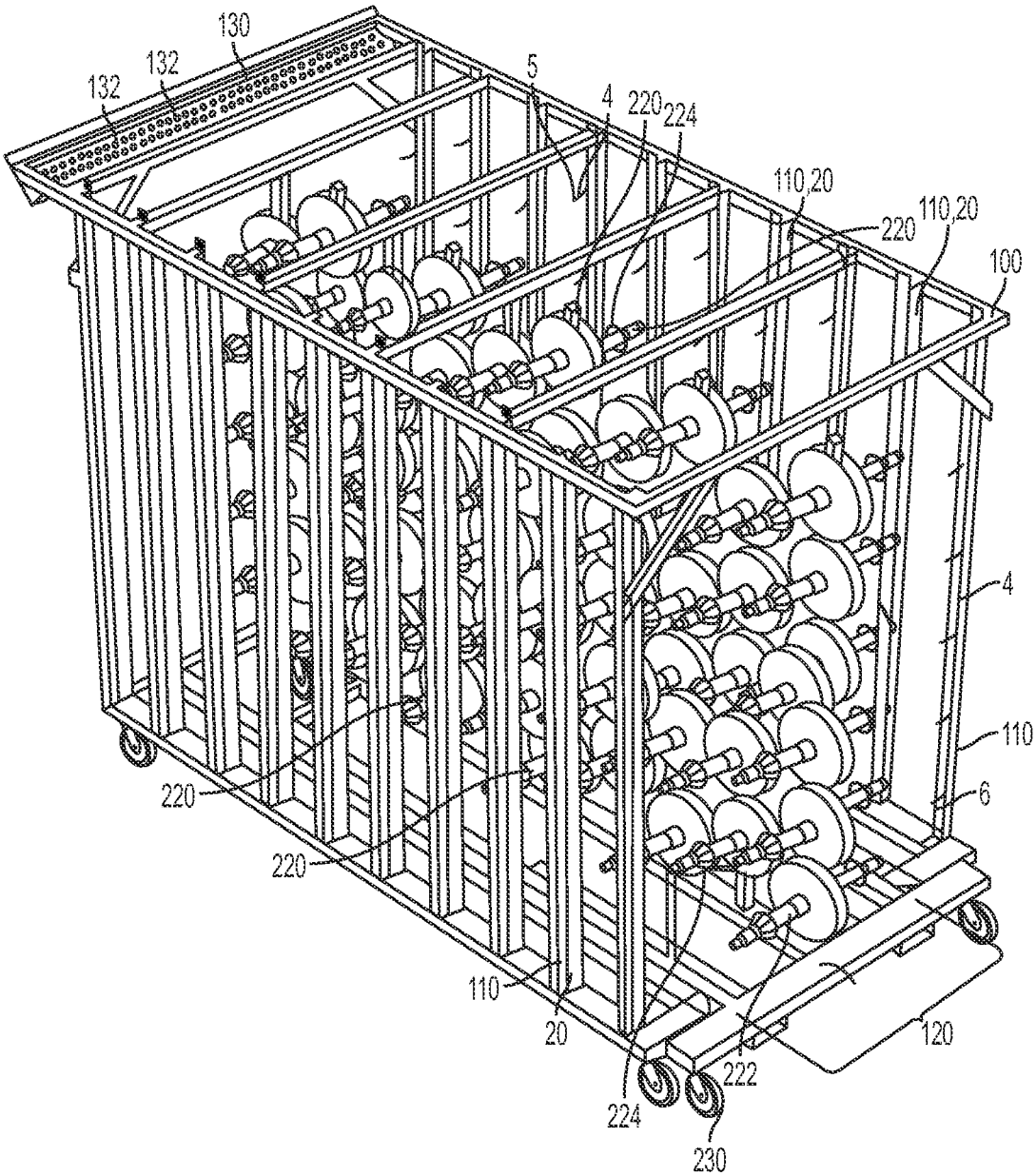

FIG. 7 is a perspective view of the yarn feed assembly of FIG. 6, illustrating the inner frame positioned therein the enclosure defined by the outer frame (the framed members 20 are omitted for optical clarity and are not shown mounted to one side of the outer frame so that exemplary yarn feed tubes can be illustrated.

Figure 8:
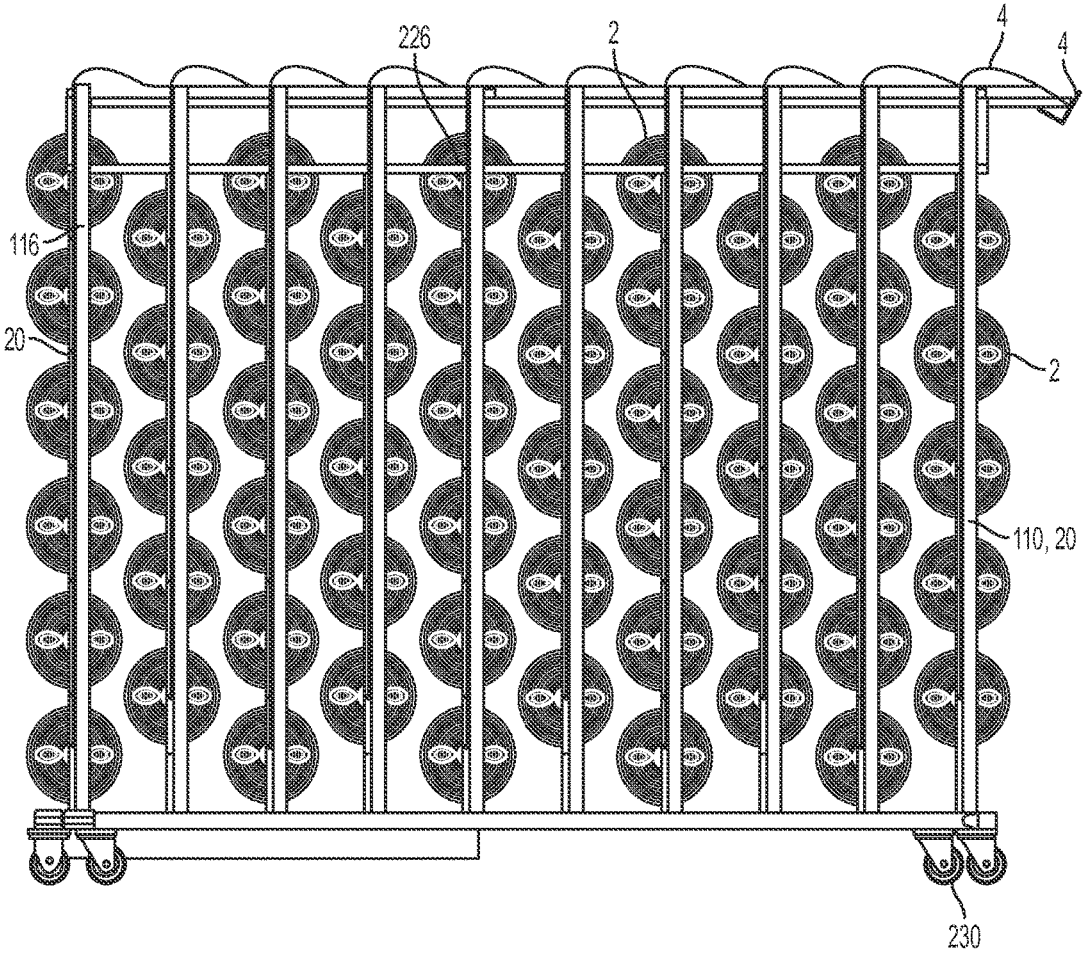

FIG. 8 is a right side elevational view of the yarn feed assembly of FIG. 6, illustrating the inner frame positioned therein the enclosure defined by the outer frame.

Figure 9:
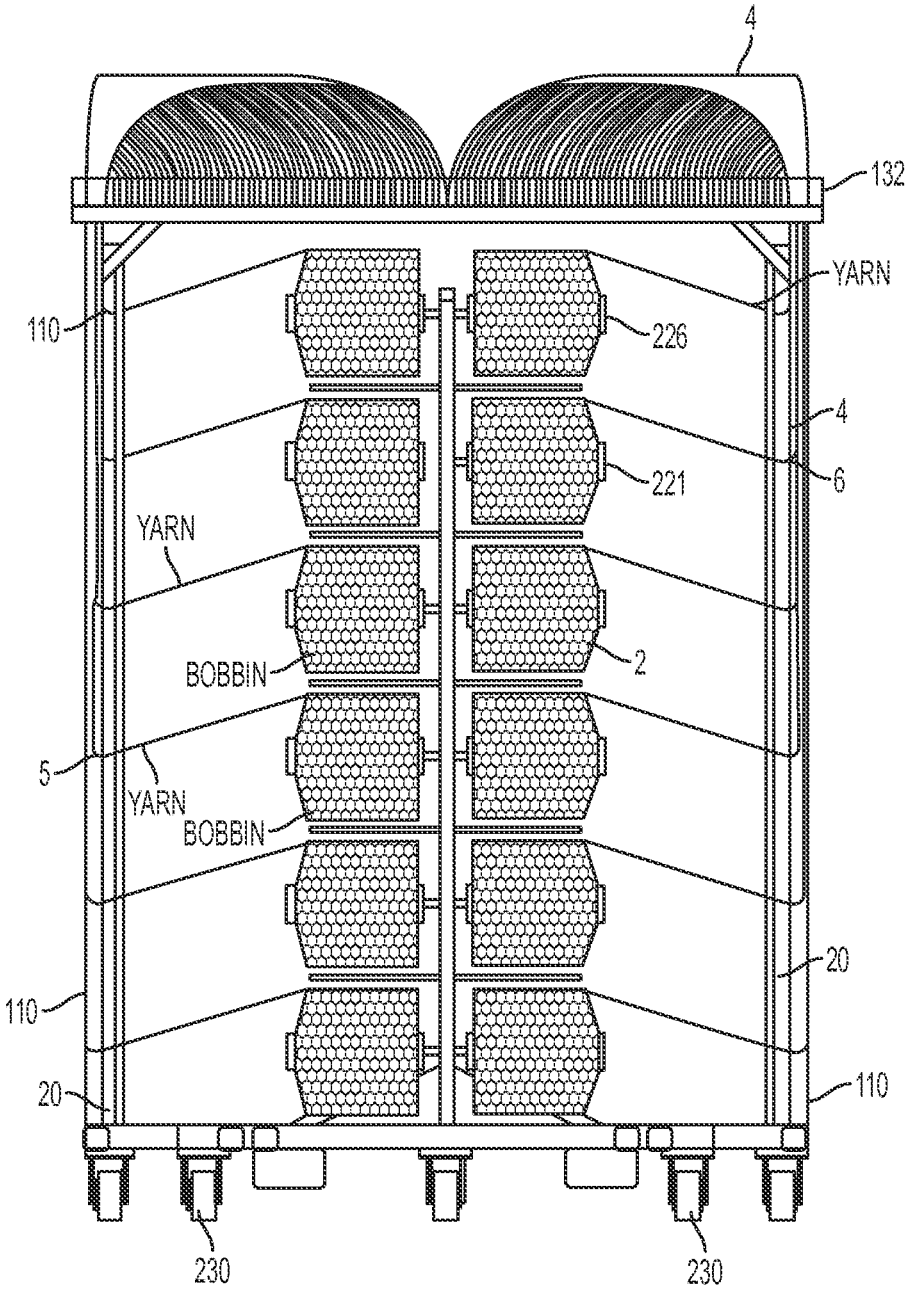

FIG. 9 is a rear elevational view of the yarn feed assembly of FIG. 7, showing the yarn holders and the tubes.

DETAILED DESCRIPTION OF THE INVENTION

The present invention can be understood more readily by reference to the following detailed description, examples, drawing, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a yarn feed tube" can include two or more such yarn feed tubes unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

Referring to the figures, in one embodiment, the invention relates to a yarn feed assembly 10 for directing yarn from a wound yarn source 2 to a yarn feed tube 4 that is configured to automatically clear yarn hang ups. As one skilled in the art will appreciate, as yarn is pulled off of a wound yarn source at a normatively operable tension level, it is desired that the yarn pulls off of the wound yarn source without hang ups that can cause operational shutdown of the pull off system, which can cause a dramatic loss in operational efficiencies because the line must remain off until the hang up is cleared. One skilled in the art will also appreciate that the present invention allows for the automatic clearing of hang ups, by variably and automatically increasing the yarn pull-off angle in response to tension increases in the yarn, above the normative operable level. As the yarn pull-off angle increases, the force necessary to release the hang up is reduces which allows for the hang up to release and the system to return to normal—all without requiring any operative stoppage of the overall system.

In one aspect, the yarn heed assembly 10 comprises a frame member 20 positioned adjacent to the wound yarn source 2. In this aspect, the frame member 10 can define at least one elongate interior chamber 22 and a parallel elongate slot 24 that has a bottom end 25 and an opposed top end 26 and is in communication with at least a portion of the elongate interior chamber.

In another aspect, the yarn feed assembly 10 can also have a weighted member 40 that is configured to be slideably received in the elongate interior chamber of the frame member. In one aspect, a bore 42 is defined in the weighted member 40 that is sized and shaped to operatively received yarn therethrough. In operation, and upon pulling one yarn off of the wound yarn source 2, through the bore 42 of the weighted member and into the yarn feed tube 4, the weighted member 40 is configured to be axially movable along a longitudinal axis of the frame member such that, in response to an increase in tension applied to the yarn as a result of yarn hang ups on the wound yarn source, the bore 42 of the weighted member can be axially movable about and between the bottom end 25 and the top end 26 of the elongate slot 24 of the frame member.

In a further aspect, under tension, the yarn extending from the wound yarn source 2 to the bore 42 of the weighted member is at a variable yarn pull-off angle o that is minimized when the weighted member is at the bottom end 25 of the elongate slot of the frame member because the yarn is being pulled through the yarn feed assembly 10 at the normative operable level and is maximized when the weighted member is at the top end 26 of the elongate slot 24 of the frame member 20 because the yarn is being pulled through the yarn feed assembly at a tension level that is higher than the normative operable level. In operation, the variable yarn pull-off angle a will increase as the pull off tension applied to the yarn increases to a pull-off angle a that allows the yarn hang up to automatically dear. Upon clearing of the hang up, which results from the increased variable yarn pull-off angle, and the subsequent decrease in excess tension applied to the yarn, the weighted member 40 will drop to the bottom end 25 of the elongate slot 24 and the variable yarn pull-off angle $\alpha$ will be minimized. One skilled in the art will appreciate that the amount that the weighted member weighs is operatively selectable such that the weighted member will not move until the tension in the yarn reaches a required level.

In one aspect, the frame member 20 has an longitudinal axis. In a further aspect, the interior chamber 22 of the frame member can have a geometric shape in transverse cross-section to the longitudinal axis of the frame member 20. In this aspect, it is contemplated that the weighted member 40 is sized and shaped for complementary slideably receipt therein the shaped interior chamber. In this aspect, it is also contemplated that the weighted member 40, which can be elongated along a major axis, can be configured to move axially therein the interior chamber 24 such that the major axis of the weighted member 40 remains substantially parallel to the longitudinal axis of the frame member 20. In one exemplary aspect, and not meant to be limiting, the cross-sectional geometric shape of the interior chamber can be rectangular, and the weighted member can have a rectangular geometric shape in transverse cross-section to the major axis of the weighted member. It is contemplated that other exemplary cross-sectional shapes could be used, to include, without limitation, an oval shape, a circular shape, a cylindrical shape, and the like.

In another aspect, the weighted member 40 can weigh between about 4 to about 50 grams; preferably between about 5 to about 40 grams; more preferred between about 6 to about 35 grams; and most preferred between about 9 and 30 grams.

In a further aspect, the weighted member 40 can further comprise a male tube projection 44 that extends outwardly from a portion of an exterior surface 46 of the weighted member. The male tube projection 44 can, for example and without limitation, extend substantially transverse to the elongate axis of the weighted member. In another aspect, a portion of the bore 42 of the weighted member can be defined therein the male tube projection 44.

In one aspect, it is contemplated that at least a portion of a tube outer surface 46 of the male tube projection 44 can be sized and shaped for operative slideable receipt therein the elongate slot 24 of the frame member. In this aspect, as the weighted member is axially moved along the longitudinal axis of the frame member, the male tube projection of the weighted member is axially movable about and between the bottom end and the top end of the elongate slot of the frame member. As one will appreciate in this aspect, the male tube projection of the weighted member and the respective bottom and top ends of the elongated slot act to constrain the longitudinal movement of the weighted member.

In an additional aspect, it is contemplated that the male tube projection can have any desired and/or complementary geometric shape, such as, for example and without limitation, a cylindrical shape. Optionally, the respective ends of the bore of the weighted member can be chamfered or otherwise rounded-off or smoothed to reduce the risk of potential damage to the yarn as it is passes through the bore of the weighted member.

In one aspect, the variable yarn pull-off angle o of the yarn feed assembly can range from between about −30°, when the bore of the weighted member is proximate to the bottom end of the elongate slot, to about +60°, when the bore of the weighted member is proximate to the top end of the elongate slot. Optionally, the variable yarn pull-off angle can range from between about −20°, when the bore of the weighted member is proximate to the bottom end of the elongate slot, to about +50°, when the bore of the weighted member is proximate to the top end of the elongate slot. It is also contemplated that the variable yarn pull-off angle can be greater than about +60° when the bore of the weighted member is proximate to the top end of the elongate slot.

In a further aspect, the distal end 5 of the yarn feed tube 4 can be positioned above the top end 26 of the elongate slot of the frame member. It is also contemplated that the distal end 5 of the yarn feed tube can be positioned above the wound yarn source 2. In one aspect, a distal end portion 6 of the yarn feed tube 4 to can be positioned at an acute angle relative to the frame member's longitudinal axis such that the distal end portion can be oriented towards the yarn feed assembly.

In one aspect, the yarn feed assembly can further comprise means for sensing if the male tube projection is positioned at the top end of the elongate slot of the frame member. Optionally, the yarn feed assembly can further comprise means for sensing if the top of the weighted member is positioned at a maximal upward position within the frame member. In these aspects, the means for sensing can comprise; for example and without limitation, a conventional pressure sensor, a conventional trip sensor, and the like.

In another optional aspect, the yarn feed assembly can further comprise means to stop pulling yarn from the wound yarn source if the male tube projection is continuously positioned at the top end of the elongate slot of the frame member for a predetermined time interval. In this aspect, the means to stop pulling yarn from the wound yarn source is operatively coupled to the means for sensing and a controller, which is operatively coupled to the portion of the system [not illustrated] that is applying the pulling tension onto the yarn.

In another aspect, it is contemplated that the frame member 20 can comprise a plurality of frame members, that the weighted member 40 can comprise a plurality of weighted members, and that the yarn feed tube 4 can comprise a plurality of yarn feed tubes. Further, it is contemplated that the at least one elongate interior chamber can comprises a plurality of elongate interior chambers that are longitudinally space along the length of each frame member. One skilled in the art would appreciate that it is contemplated that each frame member can optionally define a single elongated interior chamber that has a plurality of spaced internal stops that form/define the plurality of interior chambers.

In one aspect, the yarn feed assembly can be coupled to a creel 50 for organizing yarn packages, such as the wound yarn sources 2, and directing yarn to a tufting machine. In one aspect, the creel 50 can have an outer frame 100 and an inner frame 200, which can be selectively movable relative to the outer frame. The inner frame 100 is configured to hold a plurality of wound yarn sources 2 and the outer frame 200 comprises a plurality of yarn feed tubes configured to direct the yarn from the plurality of wound yarn sources 2 to a header that, in turn, directs the yarn from the portable creel to specific portions of a tufting machine.

In one aspect, the outer frame 100 of the creel can comprise a plurality of substantially upright support members 110 and defines an enclosure 120. In another aspect, the enclosure 120 can be open at one end and define an interior volume. In one aspect, each frame member 20 is mounted to and extends inwardly from select substantially upright support members 110. In one aspect, the substantially upright support members of the outer frame 100 can comprise pairs of opposed substantially upright support members spaced from each other by the interior volume of the enclosure. In this aspect, each frame member 20 can be mounted coplaner with and spaced from a portion of each of the select substantially upright support members forming the corresponding pairs of substantially upright support members.

The creel can also have a header 130 mountable thereon a portion of the outer frame. In one aspect, the header can define a plurality of openings 132 configured to direct yarn to a predetermined position on the tufting machine. Headers, as such, are well known in the art and it is contemplated that any commercially available header will suffice with the creel.

In a further aspect, the creel 50 can further comprise a plurality of yarn feed tubes 4, each yarn feed tube having a distal end portion 6 that is mounted thereon at least a portion of at least some of the substantially upright support members of the outer frame. In this aspect, each of the yarn feed tubes extends to and is in communication with a respective opening 132 on the header. As known in the art, yarn may be fed through the yarn feed tubes, through the header 130, and to the tufting machine.

In another aspect, the inner frame 200 can be configured to be matingly positionable within the interior volume of the enclosure. In this aspect, it is contemplated that the outer frame can be fixed relative to the tufting machine. Optionally however, the outer frame can also be portable and movable relative to the tufting machine. In this aspect, the outer frame and inner frame may move together as an assembled unit.

In one aspect, the inner frame 200 can have a plurality of upright elements 210 and a plurality of yarn holders 220 extending therefrom each upright element. The yarn holders are configured to hold a wound yarn source or bobbin. In one aspect, the yarn holders comprise a rod 222 sized and shaped to fit within the center cavity 226 of the yarn package 20. In another aspect, at least one spring clip 224 that are configured to enable a friction fit with the center cavity of the yarn package can be connected to the rod 222.

In a further aspect, a distal end 221 of each of the yarn holders 220 can be spaced a predetermined distance from the elongate slot 24 of a respective frame member 20 and the respective bore 42 of the weighted member that is operative received therein the frame member of the yarn feed assembly when the inner frame is operably positioned within the interior volume of the enclosure. In one aspect, the predetermined distance is less than the elongate length of the wound yarn source. Optionally, the predetermined distance is less than about 18 inches, or preferably less than about 12 inches.

In a further aspect, the substantially upright support members of the outer frame 100 can comprise pairs of opposed substantially upright support members spaced from each other by the interior volume of the enclosure 120. In this aspect, each upright element 210 of the inner frame 200 is coplanar with a corresponding pair of substantially upright support members and the intervening mounted yarn feed assemblies. Further, it is contemplated that the plurality of yarn holders on each of the upright elements can comprise a plurality of opposed pairs of yarn holders 220. In this aspect, each of the yarn holder of the pair of yarn holders is operably positioned to substantially face a respective substantially upright support member. In this fashion, each yarn holder is substantially adjacent, yet spaced from, the bore 42 of the weighted member 40 of the associated yarn feed assembly.

In one aspect, a portion of each of the yarns that had previously been fed through the tubes and connected through the header to the tufting machine remains exterior to the proximal end of each of the tubes. In operation, a distal end portion of each of the yarns that had previously been fed through the yarn feed tubes and connected through the header to the tufting machine can be allowed to remain exterior to the distal end of each of the yarn feed tubes after the yarns are cut. In this manner, an inner frame may be released from the interior volume and replaced with another inner frame. At this point, and in operation, each of the yarn packages may be connected to the respective yarn end that extends therefrom the respective tube and tied off.

As noted above, it is contemplated that the inner frame 200 can further comprise means for allowing the inner frame 200 to be selectively moved relative to the outer frame 100. As known in the art, any conventional method of moving a frame is contemplated. For example and without limitation, the inner frame 200 may comprise a plurality of casters 230 on a lower portion of the frame that enable the frame to roll. Similarly, the outer frame may also be selectively movable and may also comprise a plurality of casters configured to enable the outer frame to roll. It is also contemplated that the outer frame can also be positioned in fixed relation with the tufting machine.

In operation, a method of directing or pulling yarn from the wound yarn source to the yarn feed tube can comprise providing a yarn feed assembly as exemplarily described above and puffing one yarn off of the wound yarn source, through the bore of the weighted member and into the yarn feed tube. In response to tension being added to the yarn as a result of a hang up on the wound yarn source, the weighted member can be allowed to axially move along the longitudinal axis of the frame such that the bore of the weighted member is axially movable about and between the bottom end and the top end of the elongate slot. As the weighted member continues to move toward the top end of the elongate slot as a result of increasing tension on the yarn (above the normative operating tension), the variable yarn pull-off angle a of yarn extending from the wound yarn source to the bore of the weighted member continues to increase until a yarn pull-off angle is reached that allows the yarn hang up on the wound source to release, which results in a decrease of tension on the yarn and allows the weighted member to move to the bottom end of the elongate slot of the frame member as the tension in the yarn is release to, or below initially, the normative operating level.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A yarn feed assembly for puffing yarn from a wound yarn source to a yarn feed tube, the wound yarn source having a longitudinal axis, the yarn feed assembly comprising:

a frame member positioned adjacent to the wound yarn source and having an longitudinal axis, the frame member defining at least one elongate interior chamber that extends along the longitudinal axis and an elongate slot that extends parallel to the longitudinal axis, wherein the elongate slot has a bottom end and an opposed top end and is in communication with at least a portion of the elongate interior chamber, and wherein a distal end of the yarn tube is positioned adjacent the elongate slot; and a weighted member slideably received therein the elongate interior chamber, the weighted member positioned for axial movement in the elongate interior chamber and defining a bore extending through the weighted member, wherein one yarn is pulled off of the wound yarn source, through the bore of the weighted member and into the yarn feed tube, wherein, in response to tension applied to the yarn as a result of yarn hang ups on the wound yarn source, the weighted member is axially movable along the longitudinal axis of the frame member such that the bore of the weighted member is axially movable about and between the bottom end and the top end of the elongate slot, and wherein, under tension, the yarn extending from the wound yarn source to the bore of the weighted member is at a variable yarn pull-off angle that is minimized when the weighted member is at the bottom end of the elongate slot of the frame member and is maximized when the weighted member is at the top end of the elongate slot of the frame member.

2. The yarn feed assembly of claim 1, wherein the weighted member is elongated along a major axis.

3. The yarn feed assembly of claim 2, wherein the interior chamber of he frame member has a geometric shape in transverse cross-section to the longitudinal axis of the frame member, and wherein the weighted member is sized and shaped for complementary slideably receipt therein the shaped interior chamber.

4. The yarn feed assembly of claim 3, wherein the cross-sectional geometric shape of the interior chamber is rectangular, and wherein the weighted member has a rectangular geometric shape in transverse cross-section to the major axis of the weighted member.

5. The yarn feed assembly of claim 1, wherein the weighted member weighs between about 6 grams to about 50 grams.

6. The yarn feed assembly of claim 1, wherein the weighted member further comprises a male tube projection extending outwardly from a portion of an exterior surface of the weighted member, wherein a portion of the bore of the weighted member is defined therein the male tube projection.

7. The yarn feed assembly of claim 6, wherein the male tube projection has a tube outer surface that is sized and shaped for operative slideable receipt therein the elongate slot of the frame member.

8. The yarn feed assembly of claim 7, wherein the weighted member is axially movable along the longitudinal axis of the frame member such that the male tube projection of the weighted member is axially movable about and between the bottom end and the top end of the elongate slot of the frame member.

9. The yarn feed assembly of claim 8, further comprising means for sensing if the male tube projection is positioned at the top end of the elongate slot of the frame member.

10. The yarn feed assembly of claim 9, further comprising means to stop pulling yarn from the wound yarn source if the male tube projection is continuously positioned at the top end of the elongate slot of the frame member for a predetermined time.

11. The yarn feed assembly of claim 7, wherein the male tube projection has a cylindrical shape.

12. The yarn feed assembly of claim 7, wherein the respective ends of the bore of the weighted member are chamfered.

13. The yarn feed assembly of claim 1, wherein the distal end of the yarn feed tube is positioned above the top end of the elongate slot.

14. The yarn feed assembly of claim 1, wherein the variable yarn pull-off angle ranges from between about −30°, when the bore of the weighted member is proximate to the bottom end of the elongate slot, to about +60°, when the bore of the weighted member is proximate to the top end of the elongate slot.

15. The yarn feed assembly of claim 1, wherein the frame member comprises a plurality of frame members, wherein the weighted member comprises a plurality of weighted members, and wherein the yarn feed tube comprising a plurality of yarn feed tubes.

16. The yarn feed assembly of claim 15, wherein the at least one elongate interior chamber comprises a plurality of elongate interior chambers that are longitudinally spaced along the length of each frame member.

17. The yarn feed assembly of claim 15, further comprising:

an outer frame comprising a plurality of substantially upright support members and defining an enclosure, the enclosure being open at one end, and defining an interior volume, wherein each frame member is mounted to and extends inwardly from select substantially upright support members, wherein a distal end portion of each yarn feed tube is mounted thereto at least a portion of at least some of the substantially upright support members, and an inner frame matingly positionable within the interior volume of the enclosure, the inner frame having a plurality of substantially upright elements and a plurality of yarn holders extending therefrom each upright element, each yarn holder configured to hold a wound yarn source, wherein each upright element comprises a plurality of yarn holders, and wherein each of the yarn holders is spaced therefrom the elongate slot of a frame member and the respective bore of the weighted member that is operative received therein the interior chamber of the frame member when the inner frame is operably positioned within the interior volume of the enclosure.

18. The yarn feed assembly of claim 17, wherein the outer frame is positionally fixed relative to a tufting machine.

19. The yarn feed assembly of claim 18, further comprising a header mountable thereon a portion of the outer frame, the header defining a plurality of openings configured to direct yarn to a predetermined position on the tufting machine; wherein each of the yarn feed tubes extends to and is in communication with a respective opening on the header.

20. The yarn feed assembly of claim 19, wherein a distal end of each of the yarn holders is spaced a predetermined distance therefrom the elongate slot of a frame member and the respective bore of the weighted member that is operative received.

21. The yarn feed assembly of claim 20, wherein the predetermined distance is less than 18 inches.

22. The yarn feed assembly of claim 20, wherein e predetermined distance is less than 12 inches.

23. The yarn feed assembly of claim 20, wherein the predetermined distance is less than the elongate length of the wound yarn source.

24. The yarn feed assembly of claim 17, wherein the substantially upright support members of the outer frame comprise pairs of opposed substantially upright support members spaced from each other by the interior volume of the enclosure.

25. The yarn feed assembly of claim 24, wherein each frame member is co-planer with and spaced from a portion of each of the upright elements of the corresponding pair of substantially upright support members.

26. The yarn feed assembly of claim 25, wherein the yarn holders each comprise a rod configured to be positioned therethrough a center cavity of the wound yarn source, and wherein each of the yarn holders further comprise at least one spring clip mounted thereon a portion of each rod configured to hold the wound yarn source in frictional engagement with the yarn holder.

27. The yarn feed assembly of claim 26, wherein each upright element is coplanar with a corresponding pair of substantially upright support members, and wherein the plurality of yarn holders on each of the upright elements comprises a plurality of opposed pairs of yarn holders and wherein each of the yarn holder of the pair of yarn holders is operably positioned to substantially face a respective substantially upright support member.

28. The yarn feed assembly of claim 17, wherein the inner frame further comprising means for allowing the inner frame to be moved relative to the outer frame.

29. A method of directing yarn from a wound yarn source to a yarn feed tube, the wound yarn source having a longitudinal axis, comprising:

providing a yarn feed assembly comprising:

a frame member positioned adjacent to the wound yarn source and having an longitudinal axis, the frame member defining at least one elongate interior chamber that extends along the longitudinal axis and an elongate slot that extends parallel to the longitudinal axis, wherein the elongate slot has a bottom end and an opposed top end and is in communication with at least a portion of the elongate interior chamber, and wherein the distal end of the yarn tube is positioned adjacent the elongate slot; and a weighted member slideably received therein the elongate interior chamber, the weighted member positioned for biaxial movement in the elongate interior chamber and defining a bore extending through the weighted member;

pulling one yarn off of the wound yarn source, through the bore of the weighted member and into the yarn feed tube;

allowing the weighted member to axially move along the longitudinal axis of the frame member in response to tension applied to the yarn as a result of yarn hang ups on the wound yarn source such that the bore of the weighted member is axially movable about and between the bottom end and the top end of the elongate slot, wherein, under tension, the yarn extending from the wound yarn source to the bore of the weighted member is at a variable yarn pull-off angle that is minimized when the weighted member is at the bottom end of the elongate slot of the frame member and is maximized when the weighted member is at the top end of the elongate slot of the frame member.

30. The method of claim 29, wherein the weighted member is elongated along a major axis.

31. The method of claim 30, wherein the interior chamber has a geometric shape in transverse cross-section to the longitudinal axis of the frame member, and wherein the weighted member is sized and shaped for complementary slideably receipt therein the shaped interior chamber.

32. The method of claim 31, wherein the cross-sectional geometric shape of the interior chamber is rectangular, and wherein the weighted member has a rectangular geometric shape in transverse cross-section to the major axis of the weighted member.

33. The method of claim 29, wherein the weighted member further comprises a male tube projection extending outwardly from a portion of an exterior surface of the weighted member, wherein a portion of he bore of the weighted member is defined therein the male tube projection.

34. The method of claim 33, wherein the male tube projection has a tube outer surface that is sized and shaped for operative slideable receipt therein the elongate slot of the frame member.

35. The method of claim 34, wherein the weighted member is axially movable along the longitudinal axis of the frame member such that the male tube projection of the weighted member is axially movable about and between the bottom end and the top end of the elongate slot of the frame member.

36. The method of claim 29, wherein the distal end of the yarn tube is positioned above the top end of the elongate slot.

37. The method of claim 27, wherein the variable yarn pull-off angle ranges from between about −30°, when the bore of the weighted member is proximate to the bottom end of the elongate slot, to about +60°, when the bore of the weighted member is proximate to the top end of the elongate slot.

38. The method of claim 33, further comprising sensing if the male tube projection is positioned at the top end of the elongate slot of the frame member.

39. The method of claim 37, further comprising stopping directing yarn from the wound yarn source if the male tube projection is continuously positioned at the top end of the elongate slot of the frame member for a predetermined time.

* * * * *